United States Patent [19]

Chikata et al.

[11] 4,326,946

[45] Apr. 27, 1982

[54] PROCESS FOR MANUFACTURE OF SOLVENT FOR COAL LIQUEFACTION

[75] Inventors: Tsukasa Chikata; Yoshihiko Sunami; Keiichi Sasaki; Kunihiko Nishioka, all of Amagasaki, Japan

[73] Assignee: Sumitomo Metal Industries Ltd., Osaka, Japan

[21] Appl. No.: 157,837

[22] Filed: Jun. 9, 1980

[30] Foreign Application Priority Data

Jun. 12, 1979 [JP] Japan ..... 54-74441
Feb. 21, 1980 [JP] Japan ..... 55-21277

[51] Int. Cl.[3] ..... C10G 7/00; C10G 1/04
[52] U.S. Cl. ..... 208/93; 208/8 LE
[58] Field of Search ..... 208/93, 8 LE, 56, 144

[56] References Cited

U.S. PATENT DOCUMENTS 3,726,785 4/1973 Keller ..... 208/8 LE
4,051,012 9/1977 Plumlee ..... 208/8 LE
4,111,786 9/1978 Sugimura ..... 208/8 LE

*Primary Examiner*—T. M. Tufariello
*Attorney, Agent, or Firm*—Watson, Cole, Grindle & Watson

[57] ABSTRACT

A process of producing a solvent useful in coal liquefaction which includes separating the heavy liquid produced from the liquefaction of coal into a fraction boiling at 200° to 210° C., a fraction boiling at 211° to 230° C., and a fraction boiling at not less than 231° subjecting the fraction boiling at 211° to 230° C. to a hydrogenation treatment to produce a hydrogenated fraction, mixing the hydrogenated fraction with the fraction boiling at 200° to 210° C. to form a resultant mixture, and mixing a portion of the resultant mixture with a portion of the fraction boiling at not less than 231° C. Alternately, the solvent is produced from the heavy liquid by separating it into a fraction boiling at 200° C. to 210° C., a fraction boiling at 211° C. to 230° C., a fraction boiling at 231° C. to 250° C., a fraction boiling at 251° C. to 350° C. and a fraction boiling at not less than 351° C., subjecting each of the middle three fractions to a hydrogenation treatment to form three hydrogenated fractions, mixing the three hydrogenated fractions with the fraction boiling at 200° C. to 210° C. to form a resultant mixture, and mixing the resultant mixture with a portion of the fraction boiling at not less than 351° C.

2 Claims, 3 Drawing Figures

PROCESS FOR MANUFACTURE OF SOLVENT FOR COAL LIQUEFACTION

BACKGROUND OF THE INVENTION

1. Field of the Invention

This invention relates to a process for the liquefaction of coal wherein the coal is initially contacted with a solvent to form a slurry and the slurry is then hydrogenated, and more particularly to a process for the production of the solvent which can be used to form the initial coal slurry.

2. Description of the Prior Art

The chemical treatment of coal, which is a solid material having a usually high molecular weight, to produce light and heavy oils, which are liquids having low molecular weights, by subjecting the coal to a hydrogenation treatment at elevated temperatures and pressures is well known. Such a process is known as coal liquefaction. Due to the fact that the coal is a solid and thus cannot be easily supplied in a continuous fashion and at a fixed flow volume to the high pressure treatment apparatus, which may be operating at pressures of about 200 kg/cm$^2$, the coal is usually first pulverized and then contacted with a suitable solvent so as to form a slurry. Such a slurry can more easily be supplied to the high pressure treatment apparatus in a controlled manner.

The utilized solvent must have an acceptable viscosity (such as that of a medium oil) and it must be capable of effectively dispersing the coal and forming a stable slurry (if a stable slurry is not formed and it easily separates into solid and liquid phases, the solid phase (coal powder) will settle in the pipes of the treatment apparatus and interfere with the continuous liquefaction operation). In addition, a suitable solvent will be able to uniformly disperse and stabilize the products emerging from the hydrogenation treatment apparatus. Finally, the solvent should have the capacity to donate hydrogen, thereby not only helping create the initial coal slurry but also help in achieving a complete hydrogenation of the coal in the high pressure treatment apparatus. In this latter regard, if the solvent has an insufficient ability to donate hydrogen for reaction with the coal in the high pressure treatment apparatus, either the amount of coal contained per unit of solvent added to the treatment apparatus must be reduced, or else additional amounts of hydrogen gas must be supplied to the high pressure treatment apparatus. The former alternative is of course quite uneconomical as far as the overall coal liquefaction process is concerned, and the latter is quite dangerous since the apparatus is usually operating at temperatures of 400° to 450° C. and pressures of 100 to 200 kg/cm$^2$. Pursuing this latter alternative thus requires the use of very highly advanced processing techniques which would be desirable to avoid, if possible.

One conventionally used solvent for coal liquefaction is the heavy liquid which is generated in the coal liquefaction process, this heavy liquid being recirculated to contact new coal either in unmodified form or after having been modified by a single hydrogenation treatment. This heavy liquid has the proper viscosity and possesses a high affinity for coal and thus when mixed with finely pulverized coal it will create a stable coal slurry. However, the heavy liquid in unmodified form does not possess a sufficient ability to donate hydrogen to make it a totally suitable solvent.

In order to increase the ability of such heavy liquid to donate hydrogen, it can be subjected to a hydrogenation treatment. During this treatment hydrogen donating substances will be generated in the heavy liquid. However, the heavy liquid which results from coal liquefaction is a mixture of many components, some of which will not convert into hydrogen-donating substances and, in any event, the conditions under which the hydrogenation treatment takes place will cause a portion of the heavy liquid to break down into gases (methane and ethane). Thus, the yield of hydrogen-donating substances in the solvent will be at most 30%. Methods so far suggested for the liquefaction of coal, including that taught by JA-OS 1202/53, laid open for public inspection on Jan. 9, 1978 have not yet been proven to be economical, safe or operationally stable.

It is therefore an object of this invention to provide a process for the liquefaction of coal by use of a solvent.

Another object of this invention is to provide a process for the production of a solvent for use in the liquefaction of coal.

Still another object of this invention is to provide a process for the production of a solvent which permits the liquefaction of coal to be obtained in high yields.

A further object of this invention is to provide a process for the production, in high yields, of a solvent for use in the liquefaction of coal.

SUMMARY OF THE INVENTION

To provide a solvent for coal liquefaction from the heavy liquid produced in the liquefaction of coal which will have sufficient amounts of hydrogen-donating substances, the present invention separates the previously noted heavy liquid into fractions having different velocities of hydrogenation and subjects some of the fractions to and then combines certain of these fractions. More particularly hydrogenation treatments the invention effects the fractionation of the heavy liquid on the basis of boiling points, to provide fractions as follows:

(a) A fraction boiling at 200° to 210° C., which consists preponderantly of tetralin. Since this fraction already possesses a hydrogen-donating property, it has no need for hydrogenation.

(b) A fraction boiling at 211° to 230° C., which consists preponderantly of naphthalene and, therefore, enjoys the highest velocity of hydrogenation.

(c) A fraction boiling at 231° to 250° C., which consists preponderantly of methyl naphthalene. Although it has a lower velocity of hydrogenation than naphthalene, it is amply capable of hydrogenation.

(d) A fraction boiling at 251° to 350° C., which consists of polycyclic aromatic compounds. Although it has a low velocity of hydrogenation, it is still capable of producing a hydrogen-donating solvent.

(e) A fraction boiling at temperatures of not less than 351° C., which consists of polycyclic aromatic compounds containing three or more rings and is barely usable as a viscosity index improver.

From the foregoing tabulation, it can be concluded that when the fraction boiling at 211° to 230° C. which has undergone a hydrogenation treatment is mixed with the fraction boiling at 200° to 210° C. and the resultant mixture is used as a solvent for coal liquefaction, the liquefaction of coal is greatly accelerated because both the fractions abound with hydrogen-donating substances. It has been found, however, than when coal is converted into slurry by incorporation of this mixed solvent, the slurry undergoes solid-liquid phase separation and its homogeneity is accordingly impaired. It has been ascertained that the adverse effect is ascribable to the fact that the mixed solvent formed of the fraction boiling at 200° to 210° C. and the fraction boiling at 211° to 230° C. which has undergone a hydrogenation treatment possesses a considerably lower viscosity than the solvent heretofore used for coal liquefaction and also to the fact that the mixed solvent abounds with hydrogen-donating substances and, therefore, possesses relatively low aromaticity and exhibits poor affinity for coal, a substance rich in aromaticity.

The inventors, therefore, sought for a method whereby the fraction which boils at temperatures of not less than 231° C. and possesses a high viscosity and also exhibits relatively high aromaticity is incorporated in a suitable amount into the slurry. It was consequently established that this method brought about notable improvement in the homogeneity of the slurry, thus solving the problem of solid-liquid phase separation and enabling the hydrogenation reaction to proceed suitably. The fraction boiling at temperatures of not less than 231° C., however, had substantially no hydrogen-donating property. When this fraction was mixed in a large amount with either the fraction boiling at 200° to 210° C. or the fraction boiling at 211° to 230° C. which had undergone a hydrogenation treatment, therefore, the mixed solvent exhibited low hydrogen-donating capacity as a whole. When the mixing ratio of the solvent to the coal was fixed within the range of from 1 to 5 as generally practiced in the coal liquefaction, the conversion of coal liquefaction was notably lowered where the content, in the mixed solvent, of the fraction boiling at temperatures of not less than 231° C. increased beyond the level of 50%. Thus, it was found that the content in the mixed solvent of the fraction boiling at temperatures of not less than 231° C. ought to be less than 50% in order to ensure a favorable conversion. When the mixing ratio of the solvent to the coal was fixed at 5, for example, the liquefaction of coal was advantageously accomplished even if the content of the fraction boiling at temperatures of not less than 231° C. was 50%. When this mixing ratio fell in the range of from 3 to 1, however, the conversion could be prevented from falling by lowering the content in the mixed solvent of the fraction boiling at temperatures of not less than 231° C.

Where there was felt a need for ampler supply of the solvent, the product obtained by hydrogenating the fraction boiling at 251° to 350° C. could be used as an addition to the solvent. Since the fraction boiling at 251° to 350° C. contained aromatic alkyl derivatives of two to three rings, the hydrogenation treatment the condition of higher temperature and/or higher pressure.

When the fraction boiling at 231° to 350° C. was used as the solvent, it proved advantageous for the fraction to be mixed with the fraction boiling at temperatures of not less than 351° C. for the same reason as described above. Also in this case, the mixture ratio of the solvent to the coal was the same as described above.

DETAILED DESCRIPTION OF THE INVENTION

This in one preferred embodiment of this invention, the solvent for coal liquefaction is produced by separating from the product of coal liquefaction a fraction boiling at 200° to 210° C., a fraction boiling at 211° to 230° C. and a fraction boiling at temperatures of not less than 231° C, subjecting the fraction boiling at 211° to 230° C. to a hydrogenation treatment, mixing the product of the hydrogenation treatment with the whole or part of the fraction boiling at 200° to 210° C., and mixing not less than 50% of the resultant mixture with not more than 50% of the fraction boiling at temperatures of not less than 231° C.

In another preferred embodiment of this invention, the solvent for coal liquefaction is produced by separating from the product of coal liquefaction a fraction boiling at 200° to 210° C., a fraction boiling at 211° to 230° C., a fraction boiling at 231° to 250° C., a fraction boiling at 251° to 350° C. and a fraction boiling at temperatures of not less than 351° C., subjecting the fraction boiling at 211° to 230° C., the fraction boiling at 231° to 250° C. and the fraction boiling at 251° to 350° C. to separate hydrogenation treatments, mixing the products of the hydrogenation treatments with the whole or part of the fraction boiling at 200° to 210° C. and mixing not less than 50% of the resultant mixture with not more than 50% of the fraction boiling at temperatures of not less than 351° C.

A further understanding of the invention will be obtained by reference to the attached drawings taken in conjunction with the following discussion.

FURTHER DESCRIPTION OF THE PREFERRED EMBODIMENTS

Figure 1:
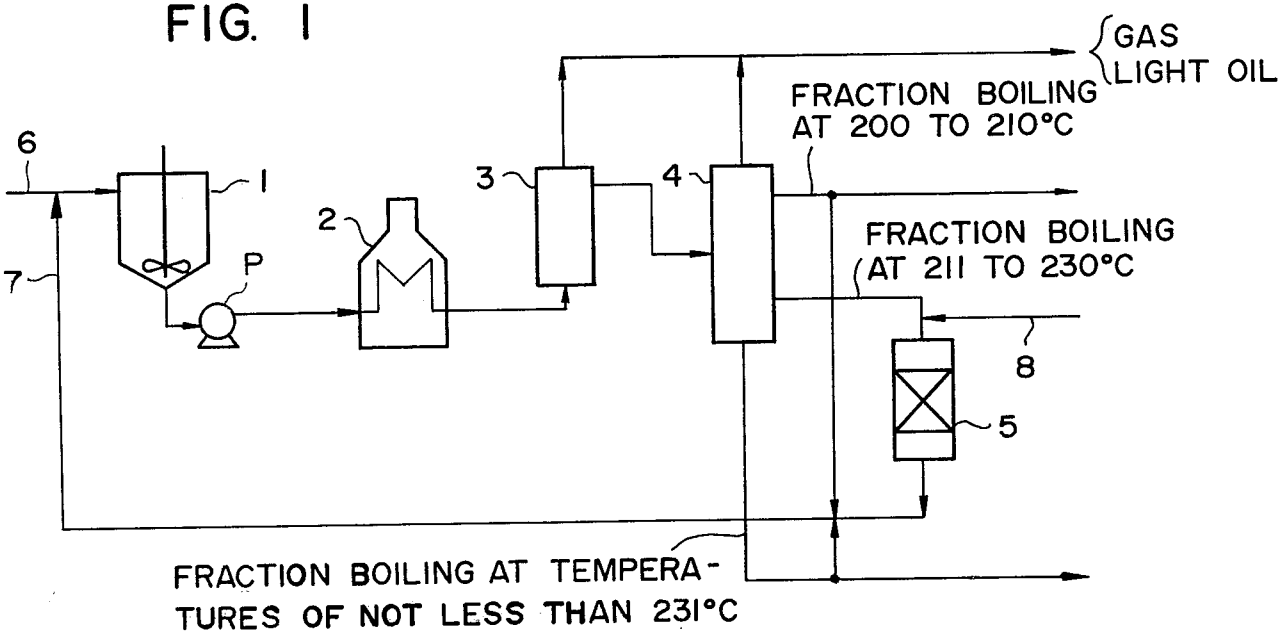
FIG. 1 shows a block diagram showing one preferred embodiment of the equipment to be used for practicing the process of this invention.

A typical apparatus for practicing the process of this invention is showin in FIG. 1.

This apparatus includes an agitation tank 1 wherein coal from line 6 and solvent from line 7 are mixed, a heating furnace 2, a dissolver 3, a distillation tower 4 and a hydrogenation tower 5 in operation coal 6 is stirred with the solvent 7 within the agitation tank 1 to form a slurry. This slurry is then conveyed by a pump P into the heating furnace 2, where it is heated to a prescribed temperature. The heated slurry is then thoroughly liquefied in the dissolver 3. The gas which is liberated from the slurry within this tank is removed via a discharge line connected to the tank's top. The product of liquefaction within the dissolver 3 overflows this tank and enters the distillation tower 4, where it is separated into gas and light oil fraction, a fraction boiling at 200° to 210° C., a fraction boiling at 211° to 230° C., and a fraction boiling at temperatures of not less than 231° C. Of the fractions and other components thus obtained, the fraction boiling at 211° to 230° C. is introduced together with hydrogen gas via line 8 into the hydrogenation tower 5, where the fraction is subjected to a hydrogenation treatment. The fraction of the boiling points of 211° to 230° C. which is discharged from the hydrogenation tower 5 is mixed with the fraction boiling at 200° to 210° C. and the fraction boiling at temperatures of not less than 231° C., and the resultant mixture is recirculated to serve as the solvent7 for the coal liquefaction.

Figure 3:
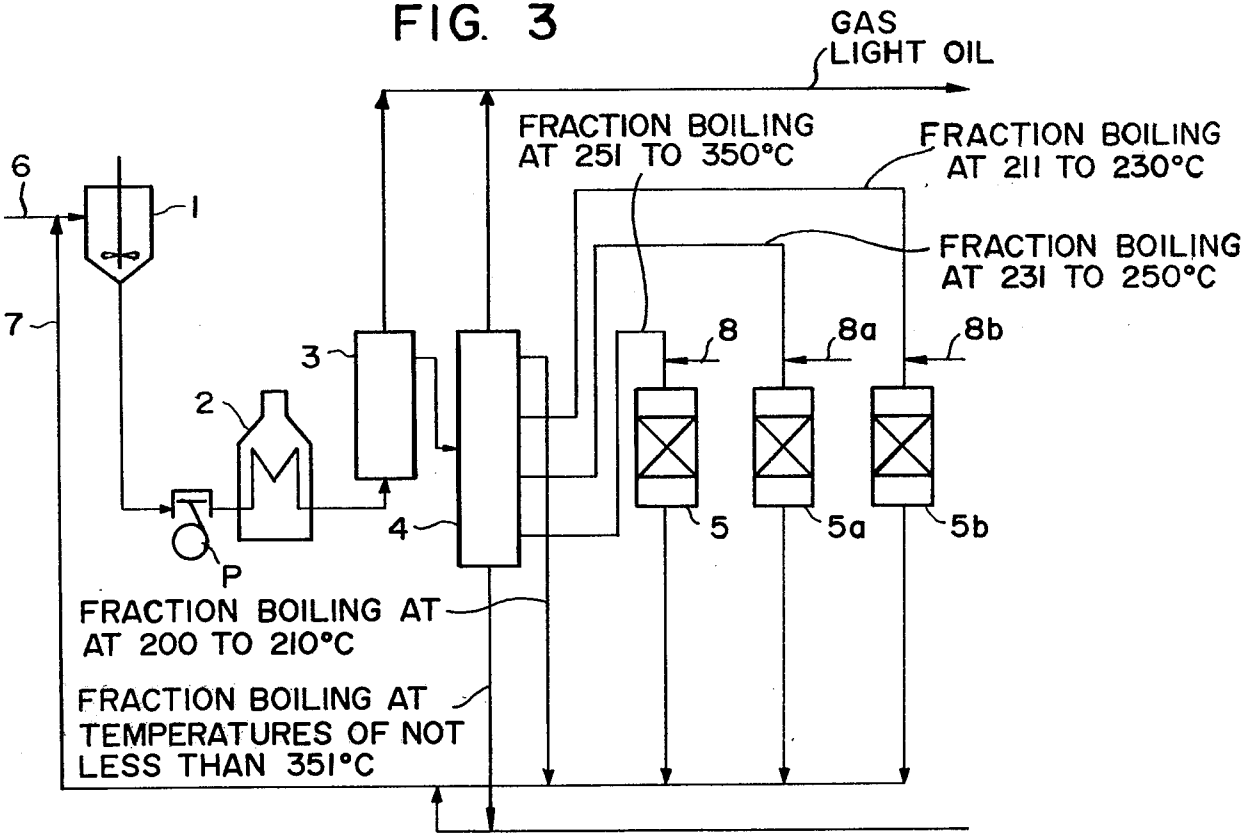
FIG. 3 shows a block diagram showing another preferred embodiment of the equipment to be used for practicing the process of the invention.

FIG. 3 illustrates another preferred embodiment of the equipment for practicing the process of this invention. The parts of the equipment which are similar to those of the equipment of FIG. 1 are denoted by like numeric symbols.

In this embodiment, the product of liquefaction discharged from the dissolving tank 3 is received into the distillation tower 4 and separated therein into gas an light oil fraction (these components boiling at temperatures of less than 200° C.,) a fraction boiling at 200° to 210° C., a fraction boiling at 211° to 230° C., a fraction boiling at 231° to 250° C., a fraction boiling at 251° to 350° C., and a fraction boiling at temperatures of not less than 350° C. Then, the fraction boiling at 211° to 230° C., the fraction boiling at 231° to 250° c. and the fraction boiling at 251° to 350° C. are introduced together with hydrogen gases from lines 8, 8*a*, 8*b* respectively, into the hydrogenation towers 5, 5*a*, 5*b*, where they are subjected to hydrogenation treatments. The three fractions which have been hydrogenated are then mixed with the fraction boiling at 200° to 210° C. and the fraction boiling at temperatures of not less than 351° C., and the resultant mixture is recirculated to serve as the solvent 7 for the coal liquefaction.

The invention will now be described with reference to working examples.

EXAMPLE 1

In a rotary autoclave having an inner volume of 5 liters, coal of the composition shown in Table 1 was subjected to trial hydrogenation in the absence of a solvent, the reaction temperature being 450° C., the reaction time being 240 minutes and the initial hydrogen pressure being 100 kg/cm$^2$G. After completion of the reaction, part of the gas present within the autoclave was removed and analyzed, and the remaining product of hydrogenation in the autoclave was shaken, extracted with benzene at room temperature for 10 hours and then suction filtered through a glass filter (pore size 5 to 10 mm) to produce a filtrate (soluble in benzene) and a residue (insoluble in benzene). In the distillation tower, the filtrate was fractionated into a fraction boiling at temperatures of less than 200° C. (hereinafter referred to as "fraction I"), a fraction boiling at 200° to 210° C. (hereinafter referred to as "fraction II"), a fraction boiling at 211° to 230° C. (hereinafter referred to as "fraction III"), a fraction boiling at 231° to 250° C. (hereinafter referred to as "fraction IV") and a fraction boiling at temperatures of not less than 251° C. (hereinafter referred to as "fraction V").

This trial hydrogenation of coal in the absence of a solvent was performed on a sample size of 1 kg/batch. Under the fixed reaction conditions, a total of five trial hydrogenations were performed to liquefy 5 kg of coal. The yield of the product obtained as the average of the results of five trial hydrogenations is shown in Table 2.

In an autoclave having an inner volume of 500 ml. and adapted to provide desired agitation of the contents by virtue of electromagnetic induction, coal was subjected to a trail liquefaction at a solvent/coal mixing ratio of 5, with each of the fractions from the product used as the solvent for coal liquefaction. The conversions of coal liquefaction obtained in the test are shown in Table 3. These conversions were determined on the basis of the respective filtrates extracted with benzene.

It is noted from Table 3 that the conversion of coal was very high when the fraction II was used as the solvent. In contrast, the conversions were low when fraction III, fraction IV and fraction V were used respectively as the solvent. This fact suggests that these fractions do not effectively serve as solvents for coal liquefaction unless hydrogen gas is additionally used.

TABLE 1

| Elementary analysis (daf %) | | | | | Volatile | Ash content |
|---|---|---|---|---|---|---|
| C | H | N | S | O diff | matter (%) | (%) |
| 77.5 | 6.2 | 1.0 | 0.3 | 15.0 | 39.8 | 10.7 |

TABLE 2

| Product | Gas | I | II | III | IV | V | Filtration residue |
|---|---|---|---|---|---|---|---|
| Yield (%) | 19.5 | 13.9 | 3.3 | 11.2 | 9.4 | 30.7 | 16.1 |

TABLE 3

| Solvent | II | III | IV | V |
|---|---|---|---|---|
| Conversion (%) | 80.8 | 24.1 | 20.7 | 30.4 |

EXAMPLE 2

In an autoclave having an inner volume of 500 ml. and adapted to provide desired agitation of the contents by virtue of electromagnetic induction, the fractions II, III, IV and V obtained in Example 1 were separately subjected to a hydrogenation treatment in the presence of a Co-Mo catalyst, the reaction temperature being 300° C., reaction time being 60 minutes and the initial hydrogen pressure being 70 kg/cm$^2$G, to afford hydrogenated fractions II', III', IV' and V', respectively. In the same autoclave as described above, coal of the composition of Table 1 was subjected to a trial liquefaction at a solvent/coal ratio of 5, with the hydrogenated fractions used separately as the solvent for coal liquefaction. After completion of the reaction, the products of coal liquefaction were extracted with benzene and analyzed for calculation of their conversions. The results are shown in Table 4.

It is noted from Table 4 that the conversions of coal liquefaction were higher when the hydrogenated fractions were used as the solvent than when the fractions in their unhydrogenated form were used as the solvent. From the results of Table 3 and Table 4, however, it is clear that even among the similarly hydrogenated fractions, the hydrogen-donating property varied depending on the type of fraction used as the solvent. To be specific, the conversions of coal liquefaction were very high when the hydrogenated counterparts of the fractions II and III were used. Particularly in the case of the fraction III, the conversion of coal liquefaction was low, for example, only 24.1% as shown in Table 3, when the fraction was used in its unhydrogenated form, whereas the conversion abruptly rose to 83.2% when the fraction was used after it had been hydrogenated. This fact indicates that the hydrogenation treatment performed on the fraction III was highly effective. In contrast, the hydrogenated fraction II' gave a conversion of 82.1% compared with a sufficiently high conversion of 80.8% which was obtained by using the unhydrogenated counterpart. This fact suggests that the fraction II has no particular need for a hydrogenation treatment and that the coal liquefaction can be accomplished in an amply high conversion by using the fraction in its unhydrated form as the solvent.

In the case of the fractions IV and V, although the hydrogenation treatment brought about some improvement in the conversion of coal liquefaction, the improvement was not so conspicuous as in the case of the fraction III. This fact suggests that so far as the fractions IV and V are used independently, the hydrogenation treatment cannot be expected to bring about any appreciable improvement in the conversion of coal liquefaction.

TABLE 4

| Solvent | II' | III' | IV' | V' |
|---|---|---|---|---|
| Conversion (%) | 82.1 | 83.2 | 46.5 | 47.3 |

EXAMPLE 3

Figure 2:
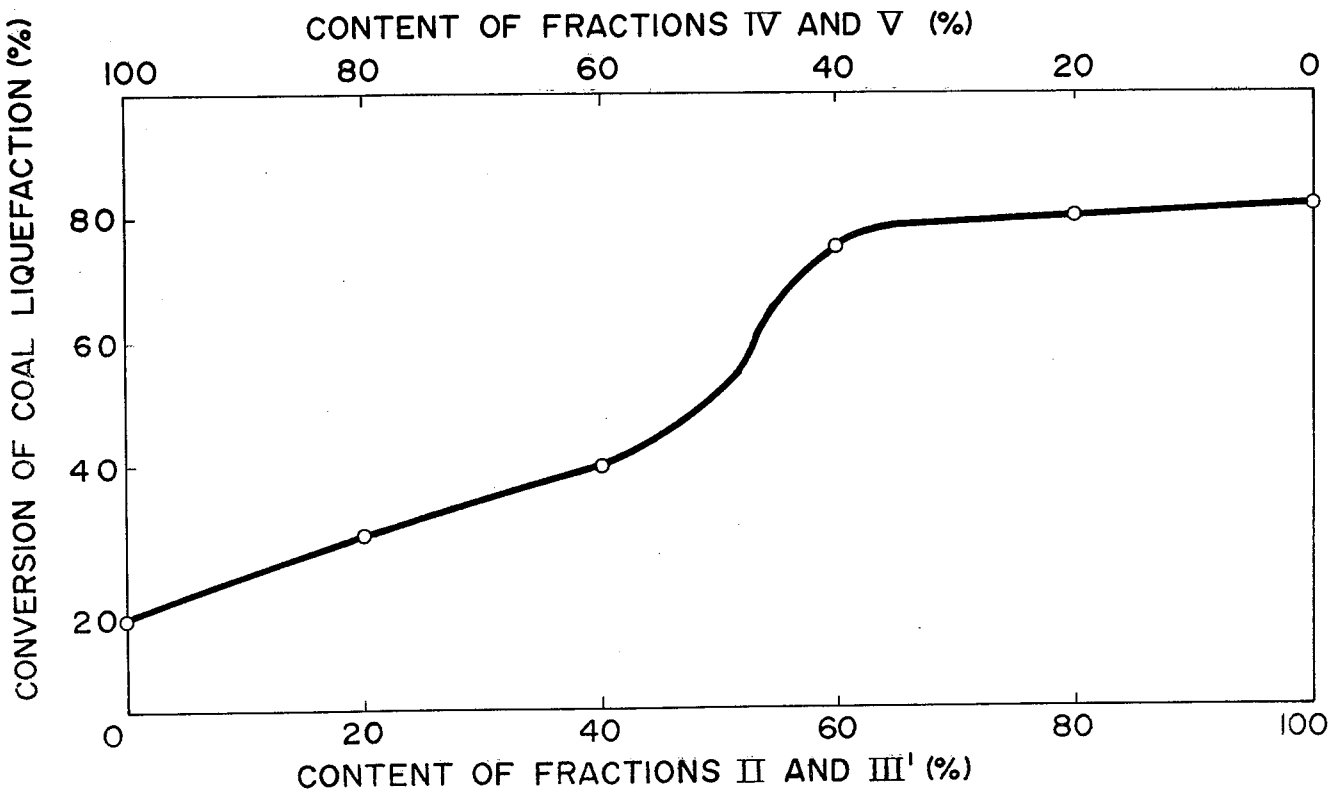
FIG. 2 shows a graph showing the relation between the solvent and the conversion of coal liquefaction as indicated in Example 3 hereof.

Among the fractions obtained in Examples 1 and 2, the fraction II was mixed with the fraction III' and the fraction IV with the fraction V, respectively. The two mixtures thus formed were mutually mixed at varying ratios to afford final mixtures. In the same apparatus as used in Example 1, coal was subjected to trail liquefaction, with the final mixtures used separately as the solvent at a solvent/coal mixing ratio of ;b 5, the reaction temperature being 400° C., the reaction time being 120 minutes and the initial nitrogen pressure being 70 kg/cm$^2$G. After completion of the reaction, the products of liquefaction were extracted from benzene and the respective conversions were calculated on the basis of the amounts of the filtration residues insoluble in the benzene. The relation between the solvent and the conversion of coal liquefaction as determined in the test is shown in FIG. 2.

It is clear from FIG. 2 that the conversion of coal liquefaction became constant in the neighborhood of 80% when the total content of the fractions II and II' in the solvent was increased above 50 to 60% and the conversion markedly decreased when the total content of the fractions II and II' fell below 50%. This fact indicates that the total content of the fractions IV and V must be not more than 50% as observed in the process of this invention.

EXAMPLE 4

In a test apparatus adapted to permit supply of slurry at a flow velocity of 2 l/hr under increased pressure, varying slurries prepared by using the solvents obtained in Examples 1 and 2 were treated separately at room temperature and 50 kg/cm$^2$ G of pressure. The properties of the slurries before the treatment and under those after the treatment are shown in Table 5.

It is clear from Table 5 that in the case of slurries prepared by using only the II+III' mixture as the solvent, the mixing ratios of the solvent to the coal notably rose after the treatment, suggesting that during the passage through the apparatus the slurries underwent solid-liquid phase separation and the solid phase of coal powder sedimented and remained within the apparatus. In the case of the slurries prepared by using the mixtures incorporating the fractions IV and V as the solvent, the mixing ratios of the solvent to the coal were substantially invariable before and after the treatment, indicating that the incorporation of the fractions IV and V was highly effective in stabilizing the slurries.

TABLE 5

| Run No. | Solvent composition (%) II + III' | IV + V | Solvent/coal mixing ratio Before treatment | After treatment |
|---|---|---|---|---|
| 1 | 0 | 100 | 5 | 5.0 |
| 2 | 50 | 50 | 5 | 5.0 |
| 3 | 90 | 10 | 5 | 5.5 |
| 4 | 100 | 0 | 5 | 8.4 |
| 5 | 90 | 10 | 1 | 1.1 |

EXAMPLE 5

In the same apparatus and under the same conditions as involved in Example 1, coal of the composition of Table 1 was subjected to trial hydrogenation in the absence of a solvent. After completion of the reaction, the product of the hydrogenation was treated under the same conditions as those of Example 1 and separated into a filtrate and a residue. In the distillation tower, this filtrate was fractionated into fraction I, fraction II, fraction III, fraction IV and a fraction boiling at temperatures of 251° to 350° C. (hereinafter referred to as "fraction $V_1$") and a fraction boiling at temperatures of not less than 351° C. (hereinafter referred to as "fraction $V_2$").

Then, parts of the fractions III, IV and $V_1$ were mixed to prepare mixtures III+IV, III+IV+$V_1$ and IV+$V_1$. In this case, the concentrations of the components of these mixtures were fixed so as to be proportionate to the yields of the corresponding fractions obtained at the time of fractionation by distillation.

In an autoclave having an inner volume of 500 ml. and adapted to provide desired agitation of the contents by virtue of electromagnetic induction, parts of the fractions II, III, IV and $V_1$ and the mixtures III+IV, III+IV+$V_1$ and IV+$V_1$ were separately subjected to a hydrogenation treatment in the presence of a Co-Mo catalyst, the reaction temperature being 400° C., the reaction time being 60 minutes and the initial hydrogen pressure being 70 kg/cm$^2$ G, to afford hydrogenated fractions II', III', IV' and $V_1$' and hydrogenated mixtures (III+IV)', (III+IV+$V_1$), and (IV+$V_1$)', respectively.

The coal was subjected to a trail liquefaction by using separately as the solvent for coal liquefaction the fractions and mixtures and the hydrogenated fractions and mixtures obtained as described above, the reaction temperature being 400° C., the reaction time, being 60 minutes the initial nitrogen pressure being 70 kg/cm$^2$ G and the solvent/coal mixing ratio being 5. The products of the liquefaction were extracted with benzene and analyzed for calculation of respective conversions of coal liquefaction. The results are shown in Table 6.

It is seen from Table 6 that the conversion was high when the fraction II was used as the solvent. This fact suggests that fraction II had no need for the hydrogenation treatment and can be used quite effectively as the solvent for coal liquefaction. Among the hydrogenated fractions which were used separately as the solvent, fractions II' and III' provided high conversions of coal liquefaction. Particularly the conversion obtained by the fraction, as compared with the low conversion of only 32.1% obtained by the original unhydrogenated fraction III, clearly suggests that the hydrogenation treatment brought about a startling increase in conversion. In the case of the fraction II', the fact that the conversion obtained by the original unhydrogenated fraction II rose past 80% implies that the hydrogenation treatment was not necessary and, in fact, was not effective.

When the fractions IV′ and $V_1$′ were used as the solvent, although the conversions of coal liquefaction were inferior to those obtained by using the fractions II and III′, they were still better than those obtained by using their respective unhydrogenated counterparts IV and $V_1$, indicating that the hydrogenation treatment was effective. When the hydrogenated mixtures (III+IV)′, (III+IV+$V_1$), and (IV+$V_1$) were separately used as the solvent, the conversions of coal liquefaction were not satisfactory. Although the conversions were superior to those obtained by using their corresponding unhydrogenated mixtures (III+IV), (III+IV+$V_1$) and (IV+$V_1$), they were considerably lower than those obtained by using the hydrogenated fractions III′, IV′ and $V_1$ independently. A possible reason for the poor conversions is that in the mixed solvents formed of two or more fractions, one component fraction or a fraction of a slower hydrogenation velocity impeded the hydrogenation occurring on another component fraction so that the overall hydrogenation velocity of the mixture was lowered. From these results, it is logically concluded that the optimum use of the fractions III, IV and $V_1$ as the solvent for coal liquefaction is obtained by subjecting these fractions separately to a hydrogenation treatment, mixing the products of the hydrogenation treatment individually with the fraction II which by nature gives a high conversion and putting the resultant mixtures to use.

TABLE 6

| Solvent | Conversion (%) |
|---|---|
| II | 80.9 |
| III | 32.1 |
| IV | 34.8 |
| $V_1$ | 30.9 |
| III + IV | 32.8 |
| III + IV + $V_1$ | 33.0 |
| IV + $V_1$ | 34.5 |
| II′ | 81.3 |
| III′ | 82.0 |
| IV′ | 63.7 |
| $V_1$′ | 60.2 |
| (III + IV)′ | 58.0 |
| (III + IV + $V_1$)′ | 54.9 |
| (IV + $V_1$)′ | 50.1 |

EXAMPLE 6

Of the fractions obtained in Example 5, the fraction II was mixed separately with the fractions III′, IV′ and $V_1$′ and the resultant mixtures were again mixed with varying amounts of the fraction $V_2$. In a shaken autoclave having an inner volume of 500 ml, the coal was subjected to a trial liquefaction with the aforementioned mixtures used separately as the solvent for coal liquefaction, reaction temperature being 400° C., the reaction time being 60 minutes, the initial nitrogen pressure being 70 kg/cm$^2$ G and the solvent/coal mixing ratio being 5. The products of the liquefaction were extracted with benzene and analyzed to determine their respective conversions. The results are shown in Table 7. The results of the flow slurr test are also shown in Table 7.

It is seen from Table 7 that the conversion of coal liquefaction was low when the content of the mixture (II+III′+IV′+$V_1$′) was low, whereas the conversion was satisfactorily high, for instance, 70%, when the solvent contained more than 50% of the mixture (II+III′+IV′+$V_1$′). This fact suggests that when the mixing ratio is fixed at 5, the content of the mixture (II+III′+IV′+$V_1$′) in the solvent ought to be not less than 50% in order to obtain the coal liquefaction at the high conversion.

Then, in a test apparatus adapted to permit supply of slurry at a flow velocity of 2 l/hr under increased pressure, slurries prepared by using, among the mixed solvents shown in Table 7, typical ones were treated separately at normal room temperature and under 50 kg/cm$^2$ G of pressure. From the results given in Table 7, it is seen that in the case of slurries prepared by using only the mixture (II+III′+IV′+$V_1$′), the mixing ratio of solvent to coal had a fairly high value of 6.5 after the treatment, indicating that the slurries, during the passage through the apparatus, underwent solid-liquid phase separation and the solid phases of coal powder sedimentated and remained within the apparatus. In the case of the solvent obtained by mixing the mixture (II+III′+IV′+$V_1$′) with the fraction $V_2$, the solvent/coal mixing ratio was substantially equal before and after the passage through the apparatus, indicating that the incorporation of the fraction $V_2$ was highly effective in stabilizing the slurry.

TABLE 7

| | | | | | | | | |
|---|---|---|---|---|---|---|---|---|
| Solvent composition (%) | II + III′IV′ + $V_1$′ | 0 | 20 | 40 | 50 | 60 | 80 | 100 |
| | $V_2$ | 100 | 80 | 60 | 50 | 40 | 20 | 0 |
| Conversion (%) | | 25.0 | 33.6 | 51.4 | 70.5 | 71.9 | 78.3 | 80.1 |
| Solvent/coal mixing ratio | Before passage | — | 5 | — | 5 | — | 5 | 5 |
| | After passage | — | 5.0 | — | 5.0 | — | 5.1 | 6.5 |

We claim:

1. A process for the production of a solvent for use in the liquefaction of coal comprising the steps of (a) substantially separating the liquid product of coal liquefaction into a first fraction boiling at 200° to 210° C., a second fraction boiling at 211° to 230° C. and a third fraction boiling at temperatures of not less than 231° C., subjecting said second fraction to a hydrogenation treatment, (c) mixing the product of the hydrogenation treatment with at least part of said first fraction to form a resultant mixture, and (d) mixing not less than 50% of said resultant mixture from step (c) with not more than 50% of said third fraction to form the solvent.

2. A process for the production of a solvent for use in the liquefaction of coal, comprising the steps of (a) separating the liquid product of coal liquefaction into a first fraction boiling at 200° to 210° C., a second fraction boiling at 211° to 230° C., a third fraction boiling at 231° to 250° C., a fourth fraction boiling at 251° to 350° C. and a fifth fraction boiling at temperatures of not less than 351° C., (b) subjecting said second fraction, said third fraction and said fourth fraction separately to hydrogenation treatments, (c) mixing the products of the hydrogenation treatments with at least part of said first fraction obtained in step (a) to form a resultant mixture, and (d) mixing not less than 50% of the said resultant mixture obtained in step (c) with not more than 50% of said fifth fraction.

* * * * *